United States Patent [19]

Gleason et al.

[11] Patent Number: 4,891,612

[45] Date of Patent: Jan. 2, 1990

[54] OVERLAP INTERFACES BETWEEN COPLANAR TRANSMISSION LINES WHICH ARE TOLERANT TO TRANSVERSE AND LONGITUDINAL MISALIGNMENT

[75] Inventors: K. Reed Gleason, Portland; Keith E. Jones, Beaverton; Eric W. Strid, Portland, all of Oreg.

[73] Assignee: Cascade Microtech, Inc., Beaverton, Oreg.

[21] Appl. No.: 267,398

[22] Filed: Nov. 4, 1988

[51] Int. Cl.[4] ..... H01P 5/00

[52] U.S. Cl. ..... 333/33; 333/34; 333/246

[58] Field of Search ..... 333/33, 34, 238, 246, 333/260

[56] References Cited

U.S. PATENT DOCUMENTS 3,218,584 11/1965 Ayer .
4,600,907 7/1986 Grellman et al. ..... 333/246
4,626,805 12/1986 Jones ..... 333/246 X

*Primary Examiner*—Paul Gensler
*Attorney, Agent, or Firm*—Chernoff, Vilhauer, McClung & Stenzel

[57] ABSTRACT

An interface structure, for connecting a pair of coplanar transmission lines in end-to-end overlapping relation to each other, employs dissimilarly-shaped overlapping end portions of the respective signal and/or ground lines of the transmission lines. The dissimilarly-shaped end portions are effective to minimize variations in the impedance of the interface structure due to variations in transverse and/or longitudinal alignment of the overlapping end portions of the respective transmission lines, thereby making the interface tolerant to misalignments.

10 Claims, 3 Drawing Sheets

OVERLAP INTERFACES BETWEEN COPLANAR TRANSMISSION LINES WHICH ARE TOLERANT TO TRANSVERSE AND LONGITUDINAL MISALIGNMENT

BACKGROUND OF THE INVENTION

The present invention relates to the interconnection of transmission lines, and particularly to the overlapped interconnection of coplanar transmission lines (coplanar waveguides) so as to minimize variations in the impedance of the interconnection due to possible transverse and/of longitudinal misalignment of the connected elements.

In high-frequency test fixtures, probes, and the like, and in the packaging or mounting of high-frequency chips, devices or circuits, it is often necessary to make temporary or permanent connections between coplanar transmission lines. Often these interconnections must be smaller or less expensive than is obtainable using a conventional connector. In such cases, it has sometimes been convenient to interconnect a pair of coplanar transmission lines by abutting them end-to-end and bridging their juncture by means of a parallel array of thin, closely-spaced conductive strips mounted on a dielectric substrate and overlapping the signal and ground lines of both transmission lines. However, this structure requires a separate connecting piece containing the thin conductive strips. A alternative type of connection is a longitudinally overlapping interface between upward-facing ground and signal lines on one transmission line and downwardfacing ground and signal lines on the other. This type of interface is more attractive because it requires no extra connecting piece.

However, a problem with both the end-to-end abutment and longitudinally overlapping types of interfaces is that any variations in transverse or longitudinal alignment of the transmission lines result in corresponding variations in the characteristic impedance of the interface, defeating the constant characteristic impedance normally desired in a transmission line and causing undesirable reflections and distortions of high frequency signals. Although this problem has been addressed to some extent in the connection of an electrical component to a stripline transmission line having signal and ground conductors on opposite sides of a dielectric substrate as shown, for example, in U.S. Pat. No. 3,218,584, the problems and solutions relevant to stripline transmission lines are not applicable to the interconnection of coplanar transmission lines. Accordingly, what is needed is an interface structure for connecting a pair of longitudinally overlapping coplanar transmission lines which permits transverse and/or longitudinal misalignments thereof without causing significant variations in the characteristic impedance of the interface.

SUMMARY OF THE INVENTION

The present invention satisfies the foregoing need by providing interface structures, for one or more pairs of longitudinally overlapping coplanar controlled-impedance transmission lines, wherein the overlapping end portions of interconnected signal and/or ground lines have dissimilar shapes so that one end portion has excess conductive material extending beyond the conductive material of the other end portion in a direction parallel to the plane of the respective transmission line. These dissimilarly shaped end portions maintain the characteristic impedance of the interface substantially constant, despite misalignment, either by preventing changes in the impedance-determining dimensions of the interface or by compensating for such changes by causing counteracting changes. (In the latter case, although individual components of the impedance change, the impedance of the interface is considered to be lumped if the overlap is short compared to the wavelength of the signal, thereby enabling the effective use of compensating impedance changes to maintain an overall characteristic impedance.)

To minimize variations in impedance due to variations in transverse alignment of the transmission lines, each of the respective end portions of the signal and ground lines of one of the transmission lines preferably has a respective transverse dimension which is greater than the transverse dimension of the overlapped end portion of the corresponding line of the other transmission line. Such a construction will maintain the transverse dimension of the combined overlapped end portions of two interconnected signal lines, and the transverse spacing between the signal line end portions and the ground line end portions, respectively, substantially constant despite variations in transverse alignment. Maintaining these two transverse dimensions substantially constant in turn maintains the impedance of the interface substantially constant despite variations in transverse alignment.

On the other hand, variations in interface impedance due to longitudinal misalignment are preferably minimized by shaping the end portions of the ground lines or signal lines so that they have transverse dimensions which increase in magnitude in a direction toward the other transmission line. In one embodiment, a gradual increase in the transverse dimension of each ground line end portion operates to reduce the inductance of the overlapped end portions as the ground lines are moved longitudinally apart, thereby counteracting increases in inductance (or decreases in capacitance) which normally result from moving the lines apart longitudinally, and vice versa. In another embodiment, a more abrupt increase in the transverse dimension of ground line end portions operates to increase the parallel capacitance between the signal line end portions and ground line end portions, respectively, as the lines are moved longitudinally apart, thereby counteracting the normal increase in inductance, and vice versa.

In a further embodiment, tolerance to both transverse and longitudinal misalignment is provided by shaping the respective overlapping signal line end portions so that their transverse dimensions increase in a direction toward the other transmission line, while concurrently making the transverse dimensions of the end portions of the lines of one transmission line greater than those of the other.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

.

DETAILED DESCRIPTION OF THE INVENTION

Figure 1A:
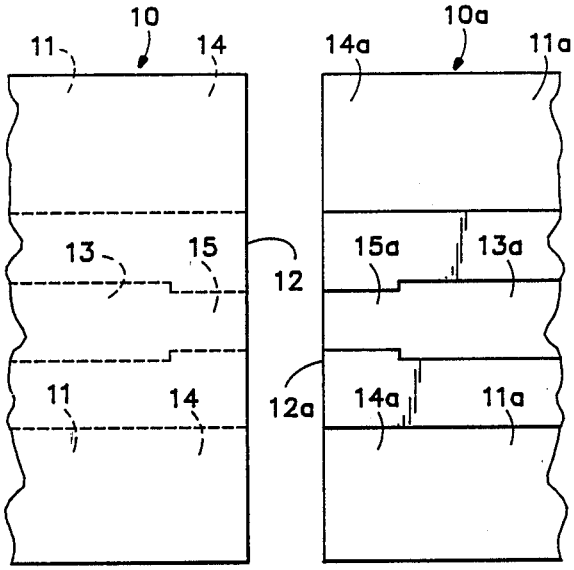
FIG. 1A PRIOR ART
FIG. 1A is a partial top view of a pair of prior art coplanar transmission lines shown in end-to-end relation prior to their interconnection.
Figure 1B:
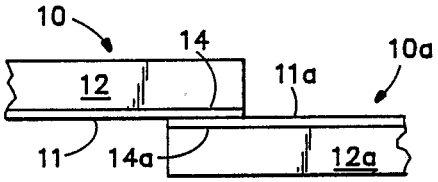
FIG. 1B PRIOR ART
FIGS. 1B and 1C are side and top views, respectively, of the coplanar transmission lines of FIG. 1A in longitudinally overlapping, interconnected relation.
Figure 1C:
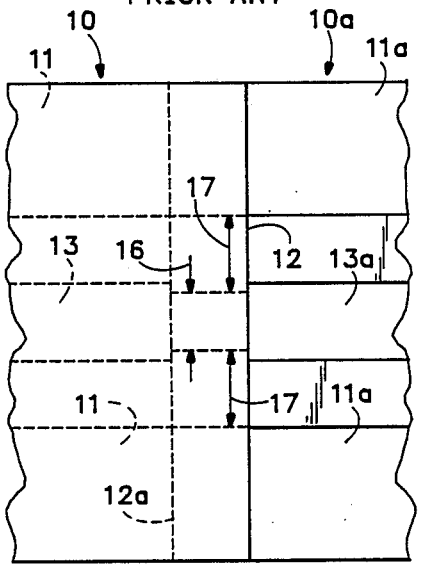
FIG. 1C PRIOR ART

FIGS. 1A, 1B and 1C depict a prior longitudinally overlapping interface structure for a pair of coplanar transmission lines 10 and 10*a*. Each of the transmission lines comprises a pair of elongate planar ground lines 11 or 11*a* deposited on a respective dielectric substrate 12 or 12*a*, with an elongate signal line 13 or 13*a* therebetween in transversely-spaced, side-by-side, coplanar relation to one another. The overlapping corresponding end portions 14, 14*a* of the respective ground lines are shaped identically to each other, as are the corresponding overlapping end portions 15, 15*a* of the signal lines. The transverse dimensions of the end portions 15, 15*a* of the signal lines are reduced equally to cause a reduction in capacitance between the signal line end portions and the ground line end portions, respectively, to compensate for the increase in capacitance resulting from the longitudinal overlapping of the dielectric substrates. Although the foregoing structure is capable of maintaining the characteristic impedance of the transmission lines at their overlapping interface, a problem arises if the two transmission lines are misaligned transversely or longitudinally. In the case of transverse misalignment, the transverse dimension 16 of the combined end portions 13, 13*a* of the signal lines becomes greater, while the transverse spaces 17 between the signal line end portions 13, 13*a* and the ground line end portions 14, 14*a* becomes less. These changes in the dimensions 16 and 17 both cause an increase in capacitance at the interface, which reduces the impedance so that it no longer matches that of the transmission lines 10, 10*a*. Likewise, longitudinal misalignment of the transmission lines in a direction causing excessive overlap increases the capacitance of the interface by increasing the overlap of the dielectric substrates 12, 12*a*, while insufficient overlap decreases the capacitance (or increases the inductance) of the interface. Both variations cause undesirable impedance variations at the interface.

Figure 2A:
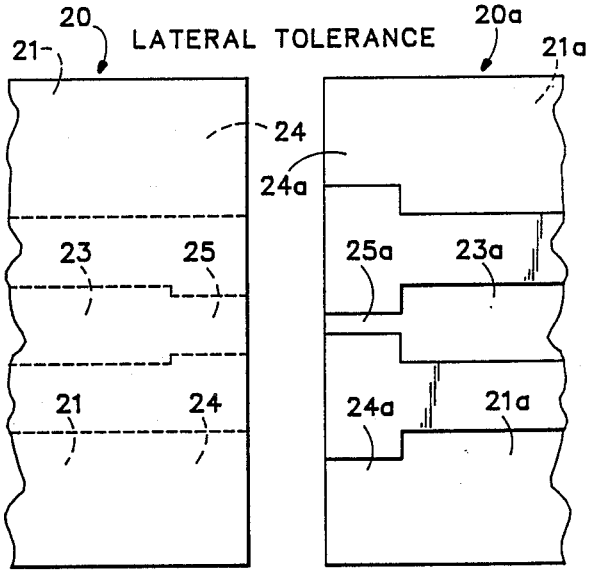
FIG. 2A is a partial top view of an exemplary pair of coplanar transmission lines, in end-to-end relation prior to their interconnection, having tolerance for transverse misalignment in accordance with the present invention.
Figure 2B:
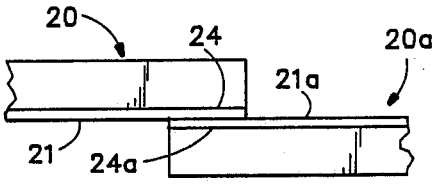
FIGS. 2B and 2C are side and top views, respectively, of the transmission lines of FIG. 2A in longitudinally overlapping, interconnected relation.
Figure 2C:
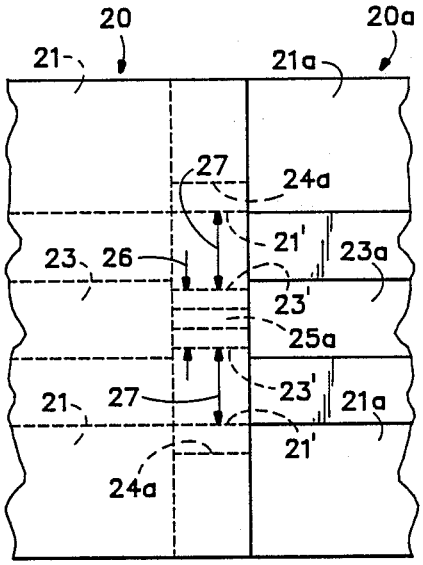

FIGS. 2A, 2B and 2C depict an improvement over the transmission lines of FIGS. 1A, 1B and 1C in that the improved transmission lines 20 and 20*a* are tolerant of transverse misalignment (but not longitudinal misalignment), i.e. they minimize variations in the impedance of the interface due to variations in transverse alignment. This tolerance to transverse misalignment is achieved by the fact that each of the end portions 24 or 25 of the lines of the transmission line 20 has a respective transverse dimension which is greater than that of the end portion 24*a* or 25*a* of the corresponding line of the other transmission line 20*a*, end portions 24*a* and 25*a* having significantly reduced transverse dimensions relative to the remainder of their respective lines. Thus, each of the end portions 24, 25, when overlapping a narrower corresponding end portion 24*a* or 25*a* as shown in FIG. 2C, has excess conductive material 21', 23' extending parallel to the plane of the transmission line 20 beyond the conductive material of the overlapped end portion 24*a* or 25*a*. Therefore, if the respective transmission lines 21, 21*a* are transversely misaligned, the transverse dimension 26 of the signal line end portions 25, 25*a*, and the transverse spaces 27 between the signal line end portions and the ground line end portions, remain constant within reasonable limits of misalignment. Accordingly, impedance variations at the interface are minimized despite variations in transverse alignment.

Figure 3A:
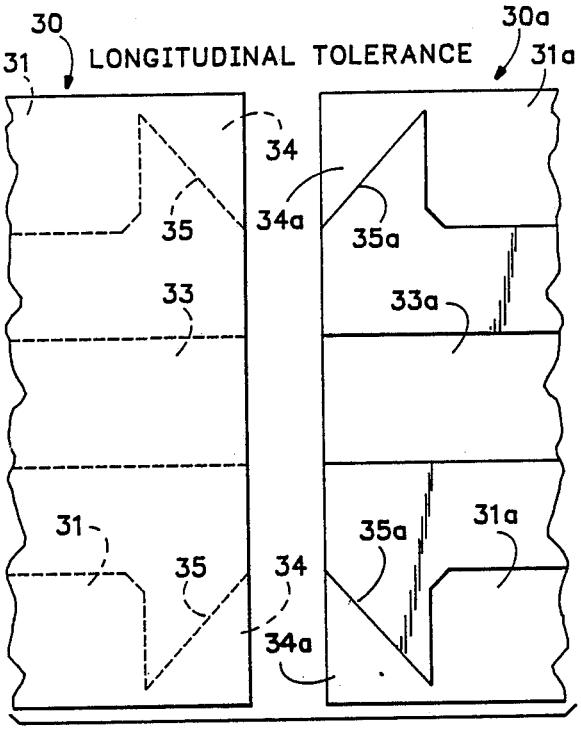
FIG. 3A is a partial top view of an exemplary pair of coplanar transmission lines, in end-to-end relation prior to their interconnection, having tolerance for longitudinal misalignment in accordance with the present invention.
Figure 3B:
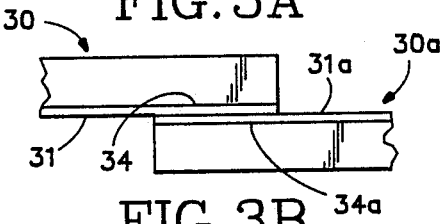
FIGS. 3B and 3C are side and top views, respectively, of the transmission lines of FIG. 3A in longitudinally overlapping, interconnected relation.
Figure 3C:
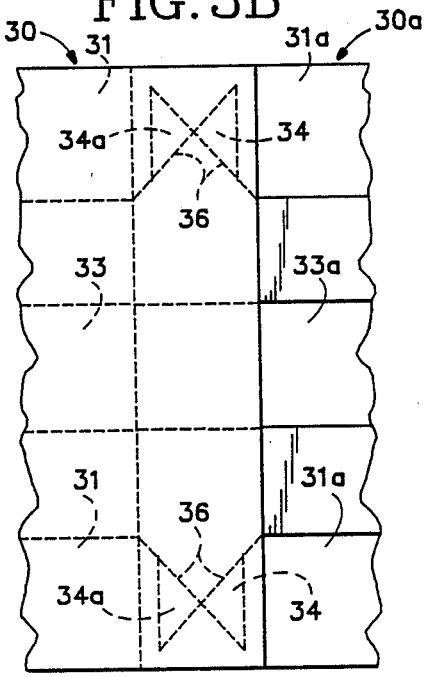

FIGS. 3A, 3B and 3C depict a pair of transmission lines 30, 30*a* which are tolerant to longitudinal misalignment by minimizing variations in the impedance of the interface due to variations in longitudinal (but not transverse) alignment. Each transmission line has a pair of ground lines 31 or 31*a*, and a signal line 33 or 33*a*, respectively. The end portions 34, 34*a* of the respective ground lines 31, 31*a* have transverse dimensions which increase in a direction toward the other transmission line gradually along the length of the respective ground line due to the angled cutouts 35, 35*a*. Thus, when the transmission lines are longitudinally overlapped as shown in FIG. 3C, each end portion 34, 34*a* has excess conductive material extending in the plane of the respective transmission line beyond the conductive material of the other corresponding end portion. This material forms a V-shaped edge 36 whose effective length diminishes as the transmission lines are pulled longitudinally apart, thereby correspondingly diminishing the inductance of the ground line end portions 34, 34*a*. This, decrease in inductance counteracts the increase in inductance (or decrease in capacitance) which normally results from pulling the transmission lines apart. A corresponding opposite compensation occurs if the elements are pushed together. Accordingly, variations in impedance of the interface are minimized despite variations in longitudinal overlap, and the interface is thus tolerant of longitudinal misalignment.

Figure 4A:
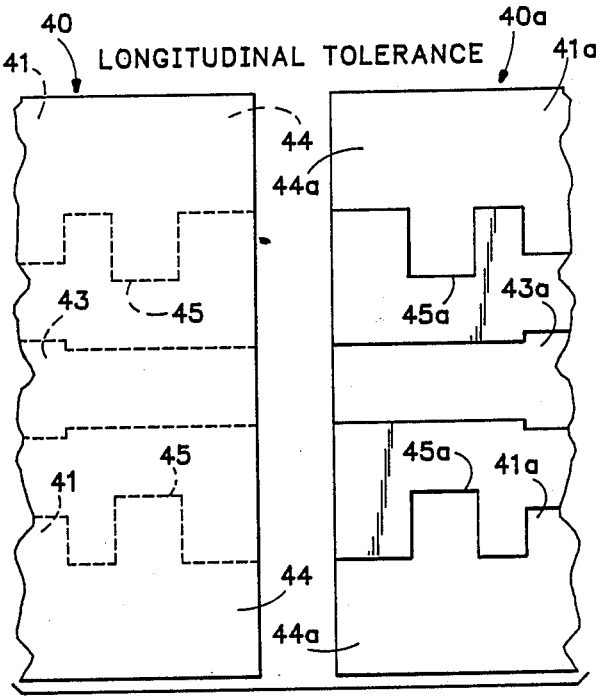
FIG. 4A is a partial top view of an exemplary alternative embodiment of a pair of coplanar transmission lines, in end-to-end relation prior to their interconnection, having tolerance for longitudinal misalignment in accordance with the present invention.
Figure 4B:
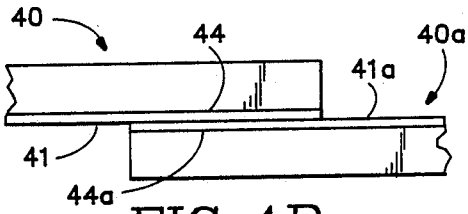
FIGS. 4B and 4C are side and top views, respectively, of the transmission lines of FIG. 4A shown in longitudinally overlapping, interconnected relation.
Figure 4C:
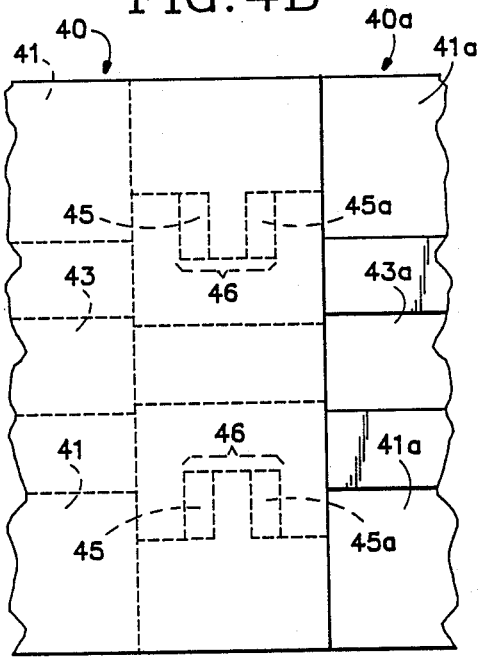

A comparable longitudinally tolerant interface structure is shown in transmission lines 40, 40*a* of FIGS. 4A, 4B and 4C. In this embodiment, the end portions 44, 44*a* of the ground lines 41, 41*a*, respectively, have inwardly-directed protrusions 45, 45*a* which are located longitudinally so that, when the transmission lines are longitudinally overlapped as shown in FIG. 4C, each protrusion 45, 45*a* includes conductive material extending beyond the material of the end portion of the other ground line. The edge 46 of the combined protrusions 45, 45a, which faces the overlapped and portions of the signal lines 43, 43a, thus changes in length as the transmission lines are pulled apart or pushed together. This has a corresponding variable effect on the capacitance between the overlapped around line end portions 44, 44a and the overlapped signal line end portions, such capacitance changing proportionally to the length of the edge 46. Thus, as the transmission lines are pulled apart, the length of each edge 46 increases, thereby increasing the capacitance and compensating for the increase in inductance (decrease in capacitance) which normally occurs due to pulling the transmission lines apart. A corresponding opposite compensation occurs when pushing the transmission lines together.

Figure 5A:
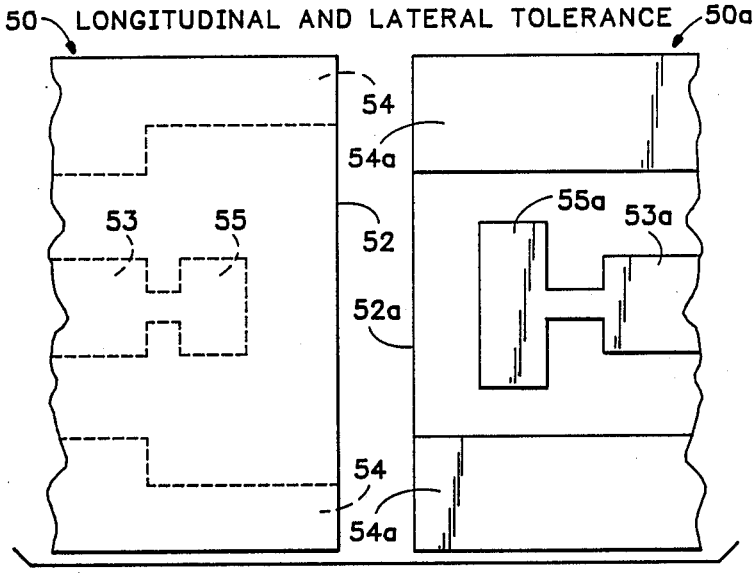
FIG. 5A is a partial top view of an exemplary pair of coplanar transmission lines, in end-to-end relation prior to their interconnection, having tolerance for both transverse and longitudinal misalignment in accordance with the present invention.
Figure 5B:
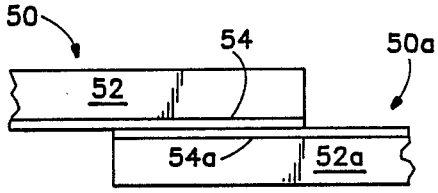
FIGS. 5B and 5C are side and top views, respectively, of the transmission lines of FIG. 5A shown in longitudinally overlapping, interconnected relation.
Figure 5C:
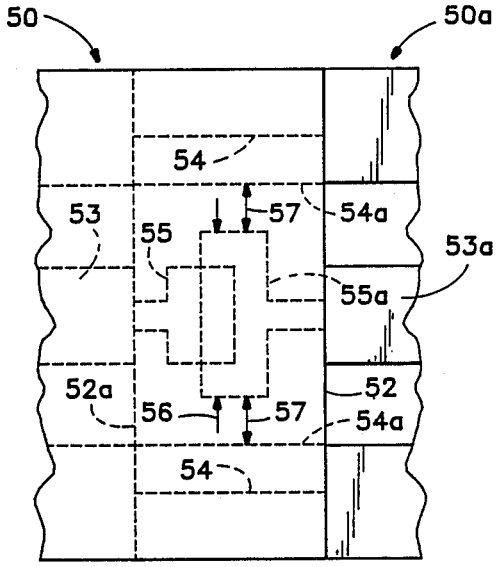

FIGS. 5A, 5B and 5C show a further embodiment comprising transmission lines 50, 50a which are effective to minimize variations in impedance resulting both from transverse and from longitudinal variations in alignment. In this embodiment, each of the ground line end portions 54a and signal line end portion 55a of the transmission line 50a has a greater transverse dimension than the corresponding end portion 54 or 55 of the other transmission line 50, so as to minimize variations in impedance of the interface due to variations in transverse alignment in accordance with the principles of the embodiment of FIGS. 2A, 2B and 2C. The excess conductive material of the wider end portions 54a, 55a keeps the transverse dimension 56 of the overlapped end portions 55, 55a and the transverse spaces 57 between the overlapped signal line end portions and the overlapped ground line end portions, constant despite variations in transverse alignment. Concurrently, each of the overlapping end portions 55, 55a of the signal lines has a transverse dimension which increases in magnitude in a direction toward the other transmission lines, and each is foreshortened relative to its respective dielectric substrate 52, 52a, respectively. Consequently, their combined area parallel to the planes of the respective transmission lines and within the overlap of the dielectric substrates increases as the transmission lines are pulled apart, thereby increasing the capacitance between the signal line end portions and the ground line end portions to compensate for the increase in inductance (reduction in capacitance), which normally would result from pulling the transmission lines apart. A corresponding opposite compensation takes place if the transmission lines 50, 50a are pushed together.

The exact sizes and shapes of the geometric arrangement of any of the foregoing embodiments will vary with the characteristic impedance of the transmission lines and the dielectric constants of the respective overlapping substrates. Although the figures show the case of overlapping substrates having similar dielectric constants, such constants could be different. In general the structure most tolerant to longitudinal misalignment, and thus requiring the least geometric compensation, is one where the dielectric constants are minimized.

It will be appreciated that numerous alternative geometric arrangements, or different combinations of the above-described geometric arrangements, can be substituted for those shown in the drawings without departing from the invention. Such alternatives are within the scope of the invention to the extent that they minimize variations in impedance resulting from variations in alignment of the transmission lines. Also, such geometric arrangements are equally applicable to coplanar transmission lines having different numbers of ground and signal lines, and to the interconnection of arrays of multiple transmission lines as well as single pairs. As used herein, the term "ground lines" encompasses comparable lines used for other purposes.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An interface structure connecting a pair of controlled-impedance, elongate coplanar transmission lines in end-to-end overlapping relation to each other comprising:

(a) a pair of dielectric substrates, each substrate mounting at least a pair of elongate planar ground lines with at least an elongate planar signal line therebetween in transversely-spaced, side-by-side, coplanar relation to one another so as to form said transmission lines, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapping corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independent of variations in said alignment along a direction transverse to the length of said elongate coplanar transmission lines;

(c) said excess conductive material including means for maintaining the transverse dimension of the combined overlapped correspondingly end portions of said signal lines, and the transverse spacing between said combined overlapped corresponding end portions of said signal lines and the respective combined overlapped corresponding end portions of said ground lines, constant despite variations in said alignment along a direction transverse to the length of said elongate coplanar transmission lines.

2. An interface structure connecting a pair of controlled-impedance, elongate coplanar transmission in end-to-end overlapping relation to each other comprising:

(a) a pair of dielectric substrates, each substrate mounting at least a pair of elongate planar ground lines with at least an elongate planar signal line therebetween in transversely-spaced, side-by-side, coplanar relation to one another so as to form said transmission lines, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapping corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independent of variations in said alignment along a direction transverse to the length of said elongate coplanar transmission lines;

(c) each of respective end portions of the signal and ground lines of said one of said transmission lines having a respective transverse dimension which is greater than the respective transverse dimension of each of the corresponding end portions of the signal and ground lines of said other transmission line.

3. The interface structure of claim 2 wherein each of the signal and ground lines of said other transmission line has an end portion having a transverse dimension which is less than the transverse dimension of the major portion of the respective signal or ground line.

4. An interface structure connecting a pair of controlled-impedance, elongate coplanar transmission lines in end-to-end overlapping relation to each other comprising:

(a) a pair of dielectric substrates, each substrate mounting at least a pair of elongate planar ground lines with at least an elongate planar signal line therebetween in transversely-spaced, side-by-side coplanar relation to one another so as to form said transmission lines, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapped corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independent of variations in said alignment along a direction parallel to the length of said elongate coplanar transmission lines;

(c) said excess conductive material including means for increasing the area, parallel to said plane and within the overlapping region of said transmission lines, of the combined corresponding end portions of said signal lines, as said signal lines are moved longitudinally apart.

5. An interface structure connecting a pair of controlled-impedance, elongate coplanar transmission lines in end-to-end overlapping relation to each other comprising:

(a) a pair of dielectric substrates, each substrate mounting at least a pair of elongate planar ground lines with at least an elongate planar signal line therebetween in transversely-spaced, side-by-side, coplanar relation to one another so as to form said transmission lines, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapped corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independence of variations in said alignment along a direction parallel to the length of said elongate coplanar transmission lines;

(c) each of the respective overlapping end portions of at least a pair of corresponding ground lines having a transverse dimension which increases in magnitude in a direction toward the other transmission line.

6. The interface structure of claim 5 wherein the magnitude of said transverse dimension increases gradually toward said other transmission line.

7. An interface structure connecting a pair of controlled-impedance, elongate coplanar transmission lines in end-to-end overlapping relation to each other comprising:

(a) a pair of dielectric substrates, each substrate mounting at least a pair of elongate planar ground lines with at least an elongate planar signal line therebetween in transversely-spaced, side-by-side, coplanar relation to one another so as to form said transmission liens, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapped corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independent of variations in said alignment along a direction parallel to the length of said elongate coplanar transmission lines;

(c) each of the respective overlapping end portions of said signal lines having a transverse dimension which increases in magnitude in a direction toward the other transmission line.

8. An interface structure connecting a pair of controlled-impedance, elongate coplanar transmission lines in end-to-end overlapping relation to each other comprising:

(a) a pair of dielectric substrates, each substrate mounting at least a pair of elongate planar signal line therebetween in transversely-spaced, side-by-side, coplanar relation to one another so as to form said transmission lines, said signal and ground lines defining the planes of the respective transmission lines, each of said ground and signal lines having a planar end portion of conductive material which electrically contacts and overlaps in a variable alignment a corresponding end portion of a line of the other transmission line so as to form a region of respective combined overlapped corresponding end portions and overlapped respective dielectric substrates, both of said substrates together overlapping said overlapped corresponding end portions;

(b) an end portion of at least one line of one of said transmission lines being shaped relative to the overlapped corresponding end portion of a line of the other transmission line so as to have excess conductive material, extending in the plane of said one of said transmission lines, beyond the conductive material of said overlapped corresponding end portion, for causing the characteristic impedance of said interface structure to be independent of variations in said alignment along directions both transverse and parallel to the length of said elongate coplanar transmission lines;

(c) each of the respective end portions of the signal and ground lines of said one of said transmission lines having a respective transverse dimension which is greater than the respective transverse dimension of each of the corresponding end portions of the lines of said other transmission line, and each of the overlapped corresponding end portions of the signal lines of the respective transmission lines having a transverse dimension which increases in magnitude in the direction toward the other transmission line.

9. An interface structure connecting a pair of controlled-impedance, elongate coplanar transmission lines in end-to-end overlapping relation to each other comprising:

(a) at least a pair of elongate planar ground lines with at least an elongate planar signal line therebetween in transversely-spaced, side-by-side, coplanar relation to one another on each of said transmission lines, each of said ground and signal lines having a planar end portion of conductive material which electrically contacts and overlaps in a variable parallel alignment a corresponding end portion of a line of the other transmission line, so as to form a region of respective combined overlapped corresponding end portions;

(b) at least a pair of overlapped corresponding end portions of said pair of transmission lines having shaped conductive means for causing the characteristic impedance of said interface structure to be independent of variations in said alignment along a direction parallel to the length of said elongate coplanar transmission lines;

(c) a portion of said interface structure being susceptible to a first change in characteristic impedance in response to a variation in said alignment, and said shaped conductive means including means for causing a second change in characteristic impedance substantially counteracting said first change in characteristic impedance in response to said variation in said alignment.

10. An interface structure connecting a pair of controlled-impedance, elongate coplanar transmission lines in end-to-end overlapping relation to each other comprising:

(a) at least an elongate planar ground lines with at least an elongate signal line therebetween in transversely-spaced, side-by-side coplanar relation to one another on each of said transmission lines, each of said ground and signal lines having a planar end portion of conductive material which electrically contacts and overlaps in a variable alignment a corresponding end portion of a respective corresponding line of the other transmission line, so as to form a region of respective combined overlapped corresponding end portions;

(b) part of said interface structure being susceptible to a first dimensional change, in response to a variation in said alignment, that causes a change in the impedance of said part of said interface structure; and (c) shaped conductive means including means for causing a second dimensional change in said interface structure, in response to said variation, that counteracts said change in the impedance.

* * * * *

UNITED STATES PATENT AND TRADEMARK OFFICE

CERTIFICATE OF CORRECTION

PATENT NO. : 4,891,612

DATED : January 2, 1990

INVENTOR(S) : K. Reed Gleason et al.

It is certified that error appears in the above-identified patent and that said Letters Patent is hereby corrected as shown below:

| | | |
|---|---|---|
| Col. 1, line 13 | Change "and/of" to --and/or--; |
| Col. 1, line 29 | Change "A" to --An--; |
| Col. 4, line 51 | Delete comma (,) after "This"; |
| Col. 5, line 2 | Change "and" to --end--; |
| Col. 5, line 6 | Change "around" to --ground--; |
| Col. 8, line 29 | Change "independence" to --independent--; |
| Col. 8, line 50 | Change "liens" to --lines--; |
| Col. 9, line 14 | Insert --planar ground lines with at least an elongate-- after "elongate"; |
| Col. 10, line 33 | Change "an" to --a pair of--. |

Signed and Sealed this

Twenty-first Day of May, 1991

*Attest:*

*Attesting Officer*

HARRY F. MANBECK, JR.

*Commissioner of Patents and Trademarks*